United States Patent [19]
Heyer et al.
[11] 4,199,835
[45] Apr. 29, 1980

[54] SCOURING BALL

[75] Inventors: Raymond F. Heyer, Saint Paul, Minn.; Gary J. Klecker, River Falls, Wis.

[73] Assignee: Minnesota Mining and Manufacturing Company, St. Paul, Minn.

[21] Appl. No.: 11,521

[22] Filed: Feb. 12, 1979

[51] Int. Cl.[2] ..... A47L 17/08
[52] U.S. Cl. ..... 15/209 B; D7/178; 15/244 R
[58] Field of Search ..... 51/397, 394, 400; D7/178, 179, 180; 15/118, 209 R, 209 B, 209 C, 209 D, 244 R, 244 A, 244 B, 244 C

[56] References Cited

U.S. PATENT DOCUMENTS

| | | | |
|---|---|---|---|
| 1,897,778 | 2/1933 | Wallace | 15/209 C |
| 2,290,216 | 7/1942 | Steinmetz | 15/244 R |
| 2,732,574 | 1/1956 | Gesell | 15/244 R |
| 2,789,305 | 4/1957 | Weil | 15/244 R |
| 2,870,472 | 1/1959 | Hartmann | 15/209 D |
| 2,958,593 | 11/1960 | Hoover | 15/209 C |
| 3,204,277 | 9/1965 | Visman | 15/244 R |

*Primary Examiner*—Billy J. Wilhite
*Attorney, Agent, or Firm*—Alexander Cruzan; Donald M. Sell; Richard Francis

[57] ABSTRACT

A scouring pad in the shape of a ball comprises a plurality of radially slit, regular-shaped, planar segments of conformable, lofty, low-density nonwoven abrasive product fastened together under compression at their centers with fastening means. The segments are slit from the outer edge toward the center to provide radially disposed, equally spaced slits which define radially aligned lobes, the total array of which defines the ball shape.

7 Claims, 6 Drawing Figures

SCOURING BALL

BACKGROUND OF THE INVENTION

1. Field of the Invention

This invention relates to scouring articles formed of lofty, low-density, nonwoven abrasive product, and, more specifically, to a novel scouring ball formed of slit segments of such nonwoven abrasive product fastened together under compression at their centers.

2. Prior Art

The use of lofty, fibrous, nonwoven abrasive products for scouring pots and pans is well known. These products are typically lofty, nonwoven open mats formed from randomly disposed crimped staple fibers which are bonded at points where they intersect and contact each other with a binder which contains abrasive. One highly commercially successful embodiment of such a pad is sold under the trade designation "Scothch-Brite" by the 3M Company of St. Paul, Minn.

Lofty, nonwoven abrasive pads can be prepared by the method disclosed by Hoover et al (U.S. Pat. No. 2,958,593). These pads are especially suited for pot and pan scouring because of their ability under normal conditions to be used for relatively long periods of time without clogging or filling. After use, they can be readily cleaned upon simple flushing with water, dried and left for substantial periods of time, and then reused.

While these pads are available in any of a variety of shapes, e.g., rectangular, circular, dumb-bell and trapezoidal, they are generally planar, i.e., of uniform thickness. There has been expressed a desire by the consumer for a more bulky nonwoven abrasive product that would substantially completely fill the hand of the user. While certain references disclose forming cleaning and/or scouring articles from coiled segments or collected segments of cleaning materials such as segments of foam material, none has been completely satisfactory.

For example, Visman et al (U.S. Pat. No. 3,204,277) discloses a cleaning device made of segments of artificial sponge material cut in the form of a flower and stacked together under compression fastened at the end of an elongate handle to form a cleaning device which lacks the desired bulk that is obtained by the cleaning pad of the present invention. Similarly, Gesell et al (U.S. Pat. No. 2,732,574) discloses a combined brush and mop which employs unslit segments of sponge material fastened at their centers under compression to form a ball-shaped mopping element. Gesell et al's method would not, however, be particularly suited for forming a conformable ball of lofty, nonwoven abrasive product since it would cause severe buckling of segments of such product.

Steinmetz et al (U.S. Pat. No. 2,290,216) discloses a dishmop formed by slitting an elongate strip of sponge rubber material to provide equally spaced slits perpendicular to the long axis, rolling the slit strip on its short side and compressing and constricting mid-section of the resultant spriral in an appropriate element to cause the slits to be deployed as an array thereby providing a mop head with a certain degree of bulk. Matthews, U.S. patent application Ser. No. 878,701, filed Feb. 17, 1978, assigned to the assignee of the present application, discloses dumbbell shaped segments of perforated nonwoven abrasive product fastened together at their small portions to form a ball-shaped array unlike the scouring ball of the present invention which employs slit segments of nonwoven abrasive material fastened at their mid points.

SUMMARY OF THE PRESENT INVENTION

The present invention provides a scouring pad substantially in the shape of a highly conformable ball, providing a desirably bulky pad which may be grasped by the user to scour kitchen utensils and for other uses.

The pad of the invention is comprised of a plurality of radially slit, regular-shaped, planar segments of conformable, lofty, low-density, nonwoven abrasive product fastened together under compression at center points. Slitting is such that lobes in the same segment are capable of being alternatively positioned at least temporarily above and below the plane of the segment. The total array of lobes in the pad defines the ball shape.

DRAWING

The invention is further illustrated by reference to the accompanying drawing, wherein like reference numerals refer to like parts in the various views, in which.

DETAILED DESCRIPTION OF THE PRESENTLY PREFERRED EMBODIMENTS

Figure 3:
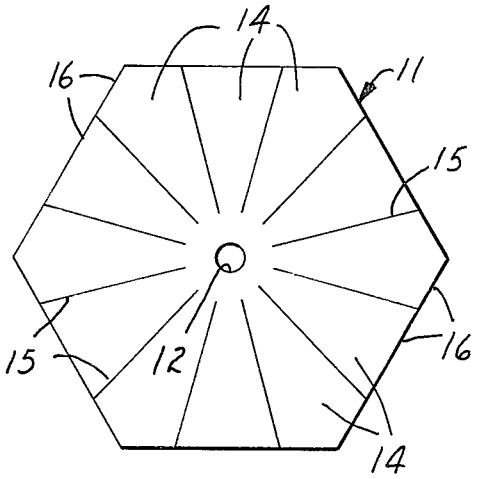
FIG. 3 is a plan view of one slit segment of lofty, nonwoven abrasive product employed to make the scouring pad depicted in FIGS. 1 and 2.
Figure 4:
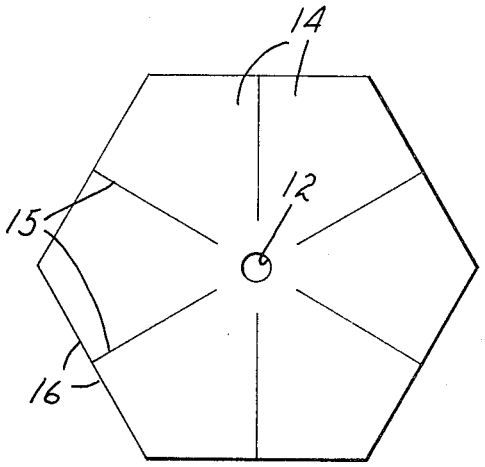
FIG. 4 is a plan view of a slit segment of lofty, nonwoven abrasive material showing an alternative pattern of slitting.
Figure 1:
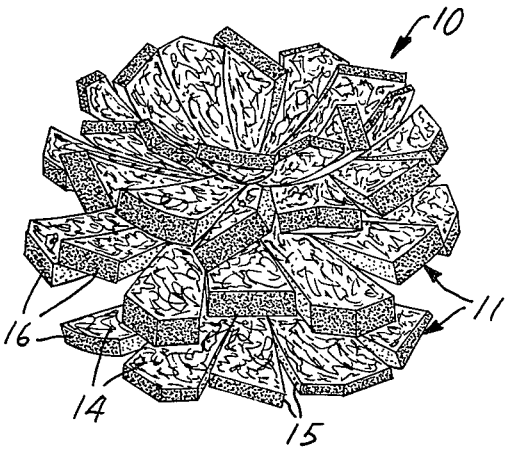
FIG. 1 is a plan view of the scouring pad of the present invention.
Figure 2:
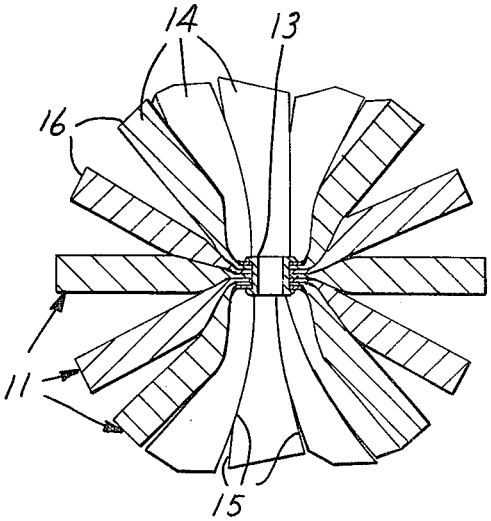
FIG. 2 is a cross sectional view of the scouring pad shown in FIG. 1 taken through the center of the pad.
Figure 5:
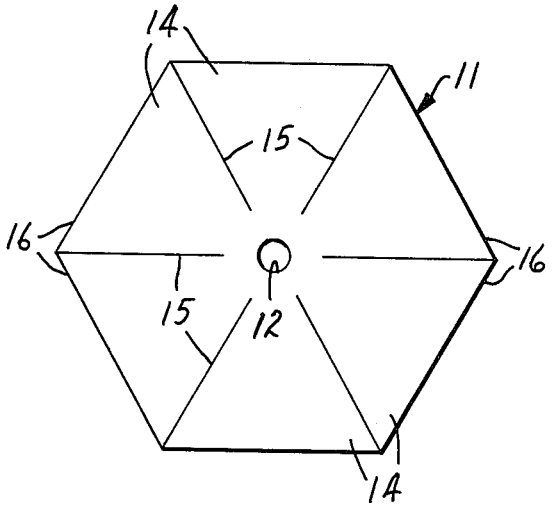
FIG. 5 is a plan view of a slit segment of lofty nonwoven abrasive material showing an alternative pattern of slitting.

Referring now to the drawings, ball-shaped scouring pad 10 according to the present invention is provided by a stack of radially slit, regular-shaped, planar segments 11 fastened together under compression at their centers 12 by mechanical fastening device 13 which holds the center portions of the segments 11 in a compressed state, thereby permitting lobes 14 defined by slits 15 to expand and assume a generally spherical shape.

The method of making scouring pad 10 involves first cutting segments 11 from sheet stock of lofty, nonwoven abrasive material. The segments may be simultaneously slit or slitting may be done in a separate operation. Slitting provides a pattern of radially aligned slits extending from outer edge 16 of segment 11 and extending from about 10% to 80% (preferably 30% to 70%) of the average radius of the segment. Slits 15 define therebetween fingers or lobes 14 in a radial array around the segment center 12. The number of slits may vary between about five to about twelve to provide a like number of lobes 14. The slits in each segment preferably extend to a point on an imaginary circle having a center at the segment center, but the slits may also terminate at various distances on either side of such circle. Each of lobes 14 will be fastened to the central portion of segment 11 by its narrowest part because of the manner of slitting. The narrowest part should therefore provide adequate attachment for the lobes to provide for long term scouring use. Preferably, the narrowest part which forms the point of attachment should be at least about 3/16 of an inch.

Several segments are stacked to form a stack or pile of segments 11 with centers 12 aligned. The stack is then compressed, at least at the center portion, and a suitable fastening means is inserted to permanently hold the center portion of the stack in a compressed state. Compression of from about 75% to aout 95% is preferred to obtain the optimum deployment of the lobes as a ball shape.

Some care is required in selecting the appropriate thickness and the average diameter to obtain the proper deployment of lobes 14 to form a ball shape. For this purpose, the stack of segments should preferably be selected to have a thickness to average diameter ratio in the range of 1:1 to about 1:3, most preferably 1:1.25 to 1:2.50. Upon slitting as herein specified, an appropriately compressed stack of segments will form lobes which in the same segment are capable of being alternatively positioned at least temporarily above and below the plane of such segment thereby to define the ball shape by the total array. This characteristic is obtained by the appropriate slitting of the segments which permits slight frictional engagement between adjacent lobes because no material has been removed from along the slit lines. If material were removed from the segment along the slit lines, as shown in Visman et al, U.S. Pat. No. 3,204,277, deployment of the lobes as described would not be possible.

Segments 11 will be regular-shaped and planar. That is, segments 11 may have a circular, polyahedron (e.g., square, hectagon, hexagon, heptagon, octagon, etc. shape), or other regular shape. The preferred shape for segment 11 is a hexagon, as shown in the drawing.

The lofty, nonwoven abrasive material from which segments 11 are formed is well known in the art and readily commercially available. Suitable lofty, nonwoven abrasive material is that sold under the trade designation "Scotch-Brite" by the 3M Company of St. Paul, Minn. Suitable lofty, nonwoven abrasive material will have a thickness on the order of ⅛ inch to about 1 inch and may vary from mildly abrasive to coarsely abrasive, depending upon use. The thickness and the average diameter of the segment 11 will vary, of course, upon the particular use for which the pad will be put. Outer diameter of a segment on the order of 2 inches to about 6 inches will be typical.

The fastening means may be any mechanical fastening device which is capable of holding the segments together under compression in the particular environment of use. An adequate fastening means is provided by a metal or rigid plastic rivet or by bonding the segments together with a bonding material. Bonding materials which are adequate include liquid curable adhesive compositions, hot melt adhesives, ultrasonic bonding which causes the thermoplastic fibers forming the lofty, nonwoven abrasive product to soften and adhere to one another, and the like. Other conventional fastening means known in the art will also be suitable.

Figure 6:
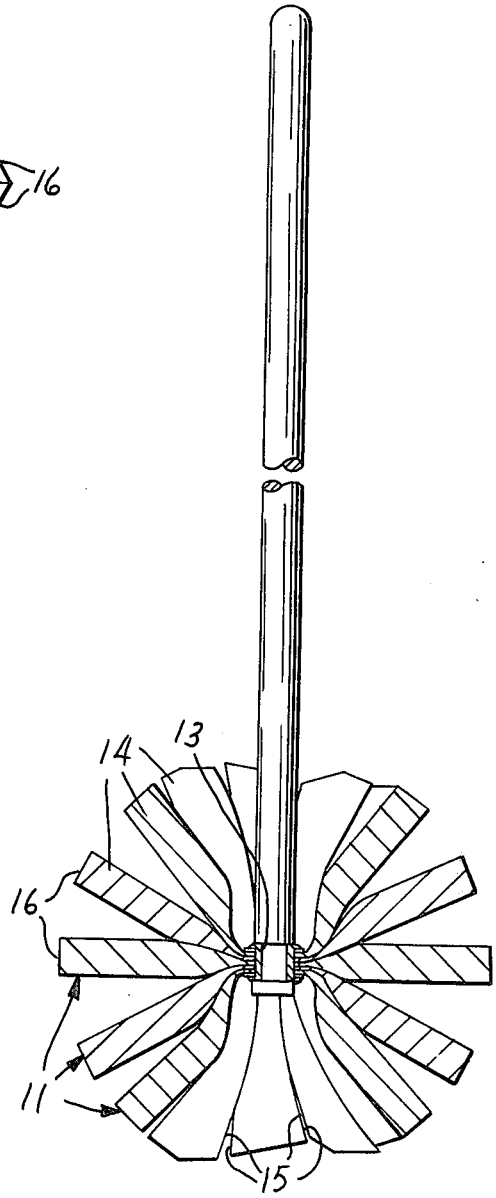
FIG. 6 is a sectional view of the scouring pad shown in FIG. 1 including an elongate handle (not shown in section).

Various modifications may be made in the scouring ball of the present invention without departing from the scope of the claims. For example, the fastening means may be secured at one end of an elongate handle as depicted in FIG. 6 to provide a scouring brush which may be employed to scour the insides of bottles, various appliances, and for other uses. Additionally, the segments may be interleaved with layers of foam material to provide for specific properties. For example, the lofty, nonwoven abrasive segments may be interleaved with layers of hydrophilic foam material to provide a greater water retention since the nonwoven abrasive material has limited water retention.

EXAMPLES

The invention is further illustrated by the following examples.

EXAMPLE 1

Five hexagonal segments 1½ inch on a side and ¼ inch thick were formed of lofty, nonwoven abrasive product (sold under the trade designation "Scotch-Brite" scouring pad by the 3M Company of St. Paul, Minn. were radially slit to provide a pattern of twelve equally spaced slits, as shown in FIG. 3 of the drawing. Each slit extended approximately 54% of the average radius of the segment from the edge toward the center. The slit segments were stacked, a rivet was inserted and the center segment of the stack was simultaneously compressed to about 12% of the uncompressed stack height. The rivet was secured to hold the center portion of the stack in the compressed state. Thereafter, the resultant lobes were deployed to form a ball-shaped scouring pad.

EXAMPLES 2–17

Examples 2–17 were prepared of the same lofty, nonwoven abrasive product as that described in Example 1 with variations in the number of slits, the length of each slit, the average diameter, and the ratio of total stack thickness to average diameter. The variations in each of the scouring balls is noted in the Table below, as are comments with respect to each example.

EXAMPLES 1–17

| Example No. | % Average Slit Length of Average Radius | Ratio of Total Thickness Average Diameter | Number of Slits | Averge Diameter (in) | Comments |
|---|---|---|---|---|---|
| 1 | 54 | 1/1 | 12 | 2.81 | Excellent ball shape, extremely dense |
| 2 | 54 | 1/1.25 | 12 | 2.81 | Excellent ball |
| 3 | 54 | 1/1.41 | 12 | 2.81 | Excellent ball |
| 4 | 54 | 1/1.87 | 12 | 2.81 | Excellent ball |
| 5 | 54 | 1/2.14 | 12 | 3.75 | Good ball |
| 6 | 56 | 1/2.25 | 12 | 3.09 | Good ball |
| 7 | 80 | 1/2.31 | 12 | 3.75 | Good ball, lobes somewhat weak |
| 8 | 32 | 1/2.31 | 12 | 3.09 | Good ball, slits could be deeper |
| 9 | 16 | 1/2.31 | 12 | 3.09 | Fair ball, slits could be deeper |
| 10 | 56 | 1/2.31 | 6 | 3.09 | Good ball, could be more slits |
| 11 | 54 | 1/2.41 | 12 | 3.75 | Good ball, could be |

-continued

| Example No. | % Average Slit Length of Average Radius | Ratio of Total Thickness Average Diameter | Number of Slits | Averge Diameter (in) | Comments |
|---|---|---|---|---|---|
| | | | | | thicker |
| 12 | 11 | 1/2.73 | 12 | 3.75 | Fair ball, total thickness could be increased |
| 13 | 11 | 1/3 | 12 | 3.75 | Fair ball, total thickness could be increased |
| 14 | 56 | 1/4 | 12 | 3.09 | Poor ball, needs to be thicker |
| 15 | 32 | 1/2.31 | 6 | 3.09 | Fair ball, slits could be deeper |
| 16 | 70 | 1/2.31 | 12 | 3.75 | Excellent ball |
| 17 | 70 | 1/2.31 | 12 | 3.09 | Excellent ball, lobes somewhat weak |

What is claimed is:

1. A scouring pad substantially in the shape of a highly conformable ball comprising a plurality of radially slit, regular-shaped, planar segments of conformable, lofty, low-density, nonwoven abrasive product fastened together under compression at their centers with fastening means, wherein the stack of segments have in the uncompressed state a thickeness to average diameter ratio in the range of about 1:1 to about 1:3, each of said segments being slit along a line from the outer edge toward its center in the average range of about 10% to 80% of the distance of said line to provide from about 5 to about 12 radially disposed equally spaced slits which define a plurality of radially aligned lobes having a width at least 3/16 inch at the narrowest point, with lobes in the same segment being capable of being alternatively at least temporarily positioned above and below the plane of such segment, whereby the total array of lobes in said pad defines said ball shape.

2. The pad of claim 1 wherein said segments are in the shape of a hexagon.

3. The pad of claim 2 wherein said hexagon is slit from each corner toward the center.

4. The pad of claim 2 wherein said hexagon is slit from points on its outer edge midway between each corned toward the center.

5. The pad of claim 1 wherein said slit is in the range of about 30–70% of the distance along said line.

6. The pad of claim 1 wherein the thickness to average diameter ratio is in the range of about 1:1.25 to 1:2.5.

7. The pad of claim 1 also including an elongate handle fastened by one end to fastening means.

* * * * *

UNITED STATES PATENT AND TRADEMARK OFFICE

CERTIFICATE OF CORRECTION

PATENT NO. : 4,199,835

DATED : April 29, 1980

INVENTOR(S) : RAYMOND F. HEYER and GARY J. KLECKER

It is certified that error appears in the above-identified patent and that said Letters Patent are hereby corrected as shown below:

In the Specification:

Col. 1, line 20, change "Scothch-Brite" to read --Scotch-Brite--

Col. 3, line 47, change "diameter" to read --diameters--

In the Claims:

Col. 6, line 24, change "corned" to read --corner--.

Signed and Sealed this

*Fifth* Day of *August 1980*

[SEAL]

*Attest:*

SIDNEY A. DIAMOND

*Attesting Officer*

*Commissioner of Patents and Trademarks*